United States Patent [19]

Rychen et al.

[11] 4,044,727

[45] Aug. 30, 1977

[54] APPARATUS FOR HEATING A HEAT TRANSFER FLUID PROTECTED AGAINST OVERHEATING

[75] Inventors: Niklaus Rychen, Bensheim, Auerbach; Peter Werner Fuchshuber, Dudenhofen, Sp., both of Germany

[73] Assignee: Konus-Kessel Gesellschaft fur Warmetechnik mbH & Co. KG, Hockenheim, Germany

[21] Appl. No.: 709,098

[22] Filed: July 27, 1976

[30] Foreign Application Priority Data

July 30, 1975 Germany ..... 2534093

[51] Int. Cl.[2] ..... F22B 37/42; F22B 27/08

[52] U.S. Cl. ..... 122/449; 122/249; 110/34; 110/75 R

[58] Field of Search ..... 110/34, 45, 75 R, 110; 122/249, 449, 448 S

[56] References Cited

U.S. PATENT DOCUMENTS

| | | | |
|---|---|---|---|
| 1,746,158 | 2/1930 | Loffler | 122/249 |
| 1,874,619 | 8/1932 | Rabe | 122/448 |
| 2,056,519 | 10/1936 | Hodgkinson | 122/448 |
| 2,127,787 | 8/1938 | Schmidt | 122/249 |
| 2,526,339 | 10/1950 | Esnault-Pelterie | 122/249 |
| 2,584,235 | 2/1952 | Skelly | 110/110 X |

*Primary Examiner*—Kenneth W. Sprague
*Attorney, Agent, or Firm*—Toren, McGeady and Stanger

[57] ABSTRACT

In an apparatus for heating a heat transfer fluid flowing through concentrically arranged pipe coils in a boiler casing, the casing is supported on top of a furnace in which solid fuel is burned in the combustion chamber. The combustion gases flow directly from the combustion chamber into the boiler casing for passage over the pipe coils. Solid fuel is supplied by a conveyer into a grate below the combustion chamber and air is supplied to a primary combustion air chamber and a secondary combustion air chamber for flow into the combustion chamber. The heat transfer fluid is circulated through the pipe coils by a pump and, if the pump becomes inoperative or flow otherwise stops, the supply of fuel and air is automatically discontinued to avoid overheating of the heat transfer fluid.

21 Claims, 3 Drawing Figures

APPARATUS FOR HEATING A HEAT TRANSFER FLUID PROTECTED AGAINST OVERHEATING

SUMMARY OF THE INVENTION

The present invention is directed to an apparatus in which a high temperature heat transfer fluid is heated while it is protected against overheating, an example of such a heat transfer fluid is a thermal oil. The apparatus includes a boiler casing enclosing a pipe coil system through which the heat transfer fluid is circulated by a pump. The boiler casing is supported on a solid fuel furnace including a combustion air blower and a conveyor for supplying the solid fuel to a grate. In particular, the invention is directed to a safety arrangement for discontinuing the heating of the pipe coil system when the pump circulating the heat transfer fluid becomes inoperative.

Similar planes are known such as disclosed in German Pat. No. 1,301,832. These plants afford the combination of the advantages of a heat transfer fluid which can be heated to a temperature of 350° C in an unpressurized system, with the use of simple solid fuels, such as wood chips obtained in carpenter shops, sawmills, chipboard industries and the like. Further, coal and other combustible wastes, for example, food industry wastes, can also be used as the fuel. To protect against overheating, a solid fuel combustion chamber is arranged in these known plants separate from the forced circulation boiler. If the electric pump affording the forced circulation should fail, a safety device insures that the combustion gases no longer flow from the combustion chamber through the boiler casing into the chimney, rather they are routed directly from the combustion chamber into the chimney. While such plants have proved to be satisfactory, they have the disadvantage of being elaborate in construction. To reduce construction costs, the applicant has built boiler planes where the furnace installation is equipped with refractory fire clay or a tamping mass formed on a foundation on which the boiler can be mounted with an opening in its bottom communicating with the combustion chamber. In this arrangement, the safety provisions against overheating also involved by-passing the hot combustion gases from the combustion chamber through an emergency chimney into the open air so that flow over the heating coils containing the heat transfer fluid is avoided.

Such planes are still quite costly, since at least the combustion chamber which is lined with bricks and whose dimension is much greater than the boiler itself, must be constructed on the site from individual parts and must be lined with a refractory material. Such a design does not lend itself to transportation, since the plant must be constructed on the spot by skilled workers of the manufacturer. In addition, the costs of the construction materials are relatively high.

Therefore, the primary object of the present invention is to provide apparatus of the above-described type which is of such compact nature that it can be factory produced as a self-contained unit and shipped to the point of use. At the point of use it is only necessary to connect the electrical lines and the heat transfer lines of the plant.

In accordance with the present invention, in an apparatus of the type described above, the boiler casing is supported on the top of the furnace which is open to admit the flow of combustion gases into the boiler casing. Within the furnace a fuel feeding device delivers solid fuel to a grate, preferably a conveyor screw is used. In addition, a combustion air blower is connected to the furnace for supplying primary and secondary combustion air into separate chambers for flow into the combustion chamber. A safety device is connected to the fuel feeding device and to the combustion air blower for rendering them inoperative if the circulation of the heat transfer fluid ceases. Preferably, the electric drives for the fuel feeding device and the combustion air blower are stopped if there is a failure in the supply of current to the electric drive for the pump circulating heat transfer fluid.

In this arrangement the combustion gases are no longer generated in the furnace, since the supply of fuel and of combustion air into the furnace are cut off. As a result, the fire within the furnace is quickly extinguished. Since combustion gases are no longer produced, there is no need to divert them as in the prior art. Naturally, the heat storage capacity of the furnace in this arrangement is preferably very low. The extent of the heat storage capacity is not very critical. In practice, thermal oil boilers are frequently fired with oil or gas with one end wall of the boiler having a high heat storage capacity compared to the end wall carrying the burner so that the thermal oil does not become unduly overheated if the current supply circulating the oil happens to fail.

To be absolutely sure that overheating does not occur in the event of a power failure, an injection device can be located in the top of the boiler through which a fire-extinguishing and energy absorbing gas, preferably $CO_2$, steam or the like, can be injected into the combustion furnace. Such injection can be effected by way of a valve, preferably a magnetic valve, which initiates the injection device automatically in the event of a power failure.

It should be noted that the thermal oil does not stop circulating completely when there is a pump failure, rather it continues to flow at a greatly reduced rate due to the differential temperatures in the pipe coil system. If the furnace is designed so that the risk of overheating the heat transfer fluid is not completely eliminated when the supply of fuel and air is discontinued, because of heat storage in the furnace, the heat transfer fluid circulating pump can be provided, though as a rule it is not necessary to do so, with an additional drive fed from a stationary energy source which is capable of supplying energy for a short duration, such as a few minutes, and becomes operative when the safety device cuts out the supply of fuel and combustion air. For this purpose an electromotor is sufficient which is operated from a storage battery and is started in a known manner to drive the heat transfer fluid circulation pump when its normal current supply is interrupted.

Safety device of the type used in accordance with the present invention are known per se. In the simplest case it is sufficient if the electric drives for the circulation pump, the combustion air blower and the fuel feed for the furnace are interconnected. In practice, the safety device can be made more elaborate in a known manner, particularly the release of the safety device can be made dependent on the temperature of the combustion gases exiting from the boiler casing and on the temperature of the fluid flowing through the boiler. Further, safety devices which normally shut off the oil or gas burner for a boiler, can also be used in the present invention.

In the present invention, the furnace is combined with the boiler to provide a portable unit with the furnace supporting the lower end of the boiler so that the upper end of the boiler casing has a cover and the pipe coil system is located within the casing. Preferably, the pipe coil system consists of two or more concentrically arranged pipe coil jackets providing serially arranged flow paths for the combustion gases flowing upwardly from the furnace into the boiler casing. Initially, the gases flow upwardly through the inner pipe coil jacket, reverse direction at the upper end of the casing and flow downwardly between the pipe coil jackets and again reverse direction at the lower end of the casing flowing over the outer surface of the outer jacket to the upper end of the casing where the gases can exit from the casing. If desired, a liquid or gaseous fuel burner can be provided in the cover of the boiler for heating it if there is no solid fuel available.

Preferably, the furnace supports both the boiler casing and the pipe coil system. Similar constructions, where the boiler casing and the pipe coil system are supported on the boiler base, are known.

Preferably, the furnace is of a steel construction with a central grate trough with primary combustion air being supplied through the grate from a chamber surrounding its bottom and sides. Further, secondary combustion air is supplied to the combustion chamber above the grate through a ring-shaped secondary combustion air chamber located radially outwardly from the combustion chamber. In this design, the secondary combustion air chamber, whose steel construction is cooled by the combustion air, provides the support for the boiler casing the pipe coil system.

The grate trough is preferably circular and is located in the center of the furnace.

While it is mentioned above that the furnace is of a steel construction, this does not mean that it is formed exclusively of steel plate. Rather, while steel plate forms most of the furnace, the bars of the grate trough and other parts can be constructed of gray iron or special cast iron.

If relatively dry solid fuels are used the furnace can be designed of a steel construction without a lining of bricks or a tamping mass which would absorb a part of the thermal energy of the combustion gases and reflect it by radiation to the bed of solid fuel. Further, such a construction is characterized by its low weight. If relatively moist fuels are used, such as sawmill waste stored in the open air, it is possible to mix such fuels with dry fuel to attain a sufficiently low moisture content. If such mixing can not be performed, the combustion chamber above the grate trough is lined with a refractory tamping mass, such as a fire clay. The refractory material reflects heat to the fuel on the grate and permits the fuel to be dried.

To insure maximum heat radiation to the fuel in the grate trough, the surface of the refractory lining is tapered or inclined so that it faces downwardly toward the grate. With this arrangement, the radiation is directed away from the pipe coil system, since the main radiation is directed from the surface of the lining around the combustion chamber. Furthermore, the opening between the furnace and the boiler casing can be arranged so that the lower end of the inner pipe coil is located radially outwardly from the opening between the furnace and the boiler casing. In this arrangement with the upper portion of the lining inclined inwardly, the bottom portion of the lining can have a relatively large diameter as can the grate trough which is particularly desirable for use with a low-energy fuel.

The secondary combustion air chamber laterally encloses the lining in the combustion chamber, accordingly, it is located radially outwardly from the chamber. As a result, the lining can be tamped on the inner surface of the secondary combustion air chamber so that the radially outer surface of the lining is cooled by the secondary combustion air.

It is preferable if a heat insulation is provided between the refractory lining and the pipe coil system. For this purpose a ring of loose rock wool can be used. However, it is preferred if the heat insulation is formed by an inwardly projecting part of the secondary combustion air chamber through which the secondary air flows. This insulating part consists advantageously of a hollow fin or bead around the upper edge of the inner wall of the annular secondary combustion air chamber. With the upper end of the inner wall of the chamber tapering inwardly, the chamber itself provides an insulating barrier between the lining in the combustion chamber and the pipe coil system for the heat transfer fluid. Accordingly, this inwardly projecting part of the secondary combustion air chamber is formed of a steel having a good thermal conductivity, such as a low-alloyed steel.

In another arrangement, the secondary combustion air chamber can laterally enclose the primary combustion air chamber. Such an arrangement is preferred where there is no lining of a refractory tamping mass. Where the combustion chamber is lined with such a refractory material the secondary combustion air chamber is preferably arranged on top of the primary combustion air chamber.

To improve the cooling action, especially in the upper region of the secondary combustion air chamber, the air inlet to this chamber can be arranged as a tangential member close to its upper edge so that the entering air tends to flow around the upper end of the secondary combustion air chamber for its entire circumference. To improve the cooling action within the secondary combustion air chamber in the range of its upper end, baffle plates can be provided in the secondary chamber which direct the incoming air over the upper surface of the chamber.

The boiler and the furnace are preferably arranged coaxially and concentrically about a common axis, as has been customary in boilers for heat transfer fluids where the heating was provided by liquid or gaseous fuels.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figures 1, 2, 3:
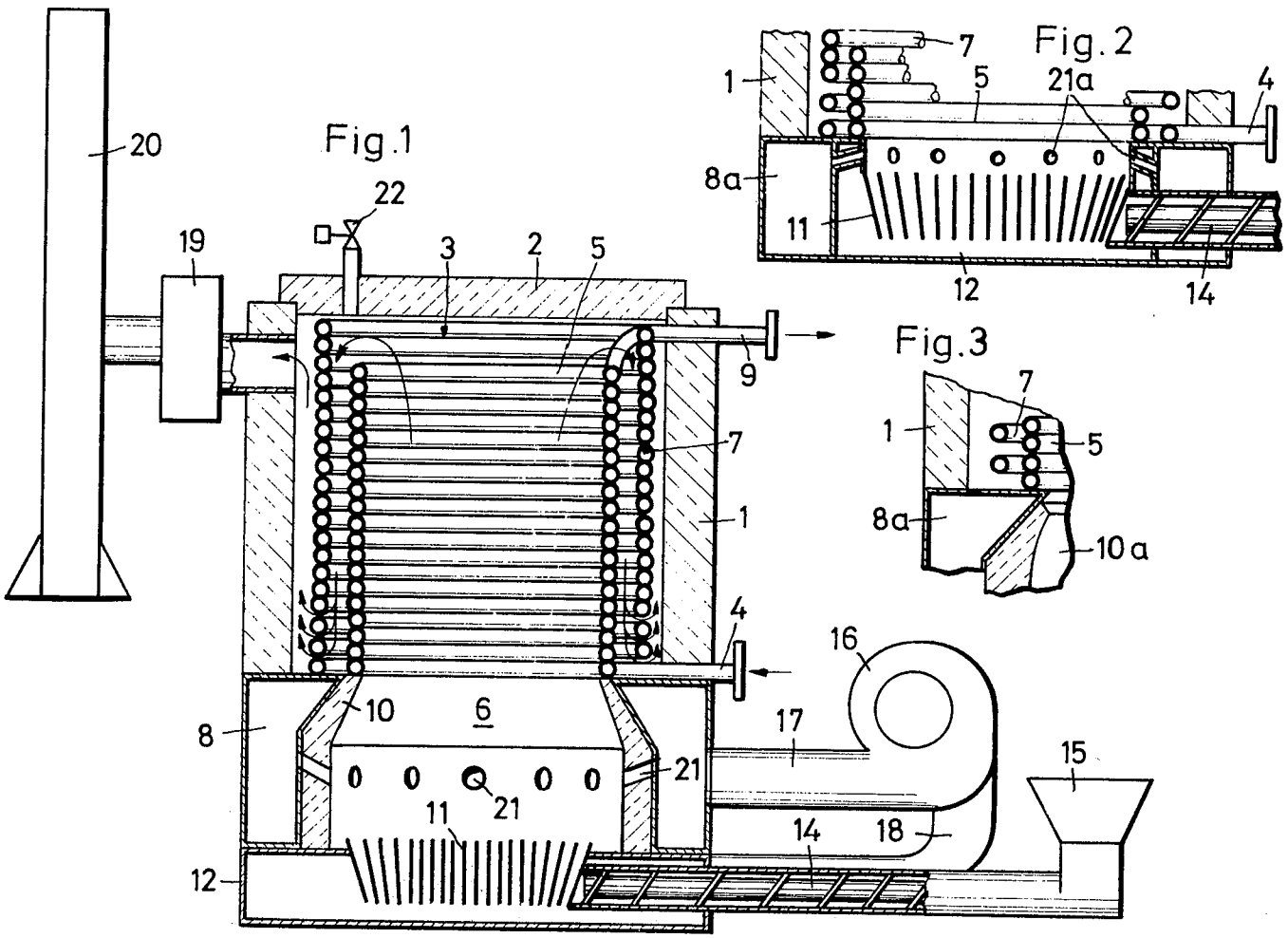
FIG. 1 is a schematic vertical sectional view through a boiler unit embodying the present invention, where, for clarity's sake, various elements located outside of the boiler unit are represented in the plane of the figure.
FIG. 2 is a partial schematic section of a bottom part of another embodiment of the invention.
FIG. 3 is a partial sectional view of still another embodiment illustrating an alternative arrangement of the refractory lining and of the secondary combustion air chamber.

As is shown in FIG. 1, the boiler unit includes a cylindrical boiler casing 1 formed of two vertically extending concentric sheet metal shells with the space between the shells filled with a heat-resistant insulating material, such as rock wool. The casing 1 is open at its upper and lower ends, however, the upper end is closed by a cover 2 which, though not shown, can include, if necessary, a burner for liquid or gaseous fuel arranged coaxially with the casing for directing its flame downwardly.

A heating pipe coil system 3 is located within the boiler casing and an unpressurized thermal oil or a pressurized water flows through it. The heat transfer fluid flowing through the pipe coil system enters through an inlet pipe 4 at the lower end of the casing. The coil system 3 includes an inner pipe coil 5 and an outer pipe coil 7 laterally and concentrically enclosing it. The inner pipe coil 5 has the adjacent individual turns of the pipe in contacting relationship providing a closed jacket-like arrangement. Similarly, the upper individual turns of the outer pipe coil 7 are disposed in contact with one another. However, the lower turns are disposed in spaced relationship providing openings between the adjacent turns. The heat transfer fluid can be supplied to the pipe coil system so that it flows through the inner and outer coils in parallel or in series from the bottom to the top. At the upper end of the pipe coils, an outlet pipe 9 conveys the heated heat transfer fluid to the system to be heated.

For the sake of simplicity, the pump circulating the heat transfer fluid through the pipe coil system is not shown, however, normally it would adjoin the outlet 9 from the boiler.

The outer pipe coil 7 is spaced radially inwardly from the inner surface of the casing 1 so that an annular space is provided over the height of the casing.

The lower end of the boiler unit shown in FIG. 1, that is, the part below the lower ends of the pipe coil system and the boiler casing 1 forms a furnace for solid fuel. The furnace includes a combustion chamber 6 laterally enclosed by a secondary combustion air chamber 8. A refractory lining 10 encircles the radially inner surface of the structure forming the secondary chamber 8 and such structure provides a support for the superposed boiler casing and inner and outer pipe coils 5, 7. A grate through 11 is located in the lower end of the combustion chamber 6 and a primary air chamber 12 is located below and laterally around the grate.

Primary combustion air chamber 12 has the form of a low cylindrical hollow body with a central opening in its upper side occupied by the grate trough 11. With this construction, primary combustion air can flow through the grate trough 11 from the bottom and around all of its sides. The solid fuel is fed to the grate through 11 by means of a screw conveyor 14 driven in a known manner by an electric motor, not shown, with the fuel being supplied to the inlet end of the conveyor from the hopper 15.

The secondary combustion air chamber 8 extends upwardly from the upper surface of the primary chamber 12 and the radially outer surface of the secondary chamber is flush with the subjacent radially outer surface of the primary chamber. The secondary chamber 8 is in the form of a hollow cylindrical ring having a generally upright rectangular cross section, however, the upper inner wall of the chamber projects upwardly into contact with the upper wall chamber and forms an inwardly directed ring-shaped fin which is triangular in cross section. This inwardly projecting triangular shaped portion of the secondary combustion air chamber 8 protects the pipe coils from any undesired heating action or radiation of the lining 10 and it also provides a cooling action for the bottom part of the boiler. As mentioned above, the inner surface of the inner wall of the secondary chamber 8 is coated with the refractory lining 10 which may be formed of a fire clay. To direct any radiant heat from the refractory lining 10 away from the pipe coils 5, 7 during operation of the boiler unit, the lining is inclined inwardly in the upper region, immediately below the boiler casing, so that the radiant heat is directed downwardly toward the grate trough 11. With this arrangement, the heat radiating from the inner surface of the refractory lining 10 is directed toward the grate 11 and away from the pipe coils 5, 7 so that overheating of the heat transfer fluid by such radiation is avoided in the event the pump fails to circulate the fluid through the coils.

In FIG. 3 a particularly favorable arrangement is illustrated for protecting the pipe coils with the upper wall of the secondary combustion air chamber **8*a* projecting inwardly beyond the radially inner surface of the inner pipe coil 5. Furthermore, the refractory lining 10*a* is recessed below the upper end of the secondary chamber 8*a*** for limiting any radiation directed toward the pipe coils.

An electrically operated combustion air blower 16 flows secondary combustion air through line 17 into the chamber 8 and primary combustion air through line 18 into the chamber 12.

An exhaust fan 19 is connected to the upper end of the boiler casing 1 for withdrawing combustion gases after their flow over the pipe coil system. The fan 19 directs the exhaust gases into a chimney 20.

In the cover 2 of the boiler casing 1 there is provided an injection valve 22 through which fire extinguishing gas can be directed downwardly into the boiler unit.

The primary combustion air flows from the chamber 12 through the gaps between the grate bars in the grate trough 11.

The secondary combustion air, which insures complete combustion of the fuel, is fed to the combustion chamber 6 above the grate 11 through air passing through the inner wall of the secondary chamber 8 and through the refractory lining 10. The ducts 21 extend tangentially of the circumferential surface of the combustion chamber 6 and are equidistantly spaced about the chamber.

In addition, though not shown, an additional heater can be provided passing through the secondary combustion air chamber 8, if necessary, to ignite the fuel on the grate trough 11. Further, a burner, not shown, can also be provided through the cover 2, as has been mentioned above. Additionally, ignition of the fuel on the grate can be effected manually.

In the operation of the boiler unit, the fuel is continuously fed to the grate 11 by means of the screw conveyor 14 while the blower 16 supplies combustion air into the primary chamber 12 and the secondary chamber 8. The fuel, such as wood chips, burns on the grate trough and the hot combustion gases rise upwardly through the combustion chamber 6 and into the centrally arranged space within the inner pipe coil 5. Any fuel carried upwardly by the gases can be completely burned as it flows through the central space within the pipe coil 5. The heat transfer fluid, such as thermal oil, is pumped continuously by a pump, not shown, through the pipe coils 5, 7. Initially, the combustion gases flow upwardly through the central space passing over the inner surfaces of the individual turns of the inner pipe coil 5, note the arrows. At the upper end of the central space, the combustion gases reverse direction and flow downwardly through the annular space between the outer surface of the inner pipe coil and the inner surface of the outer pipe coil. Since the adjacent individual turns of the inner pipe coil are in contact with one another the upwardly flowing gases in the central space must traverse its full height before flowing downwardly within the annular space between the two pipe coils. Similarly, since the adjacent individual turns of the pipe coils in the upper end of the outer pipe coil are in contact the combustion gases must flow downwardly through the annular space to its lower end. At the lower end of the outer pipe coil, as can be seen in the drawing, the adjacent individual turns of the pipe coils are spaced apart so that the combustion gases can pass into the outer annular space between the outer surface of the outer pipe coil 7 and the inner surface of the boiler casing 1. After the combustion gases complete their upward passage through the outer annular space they are drawn off through the outlet opening in the upper end of the boiler casing by the exhaust fan 19 and flow out through the chimney 20.

If the forced circulation of the terminal oil flowing through the pipe coil system should fail, the screw conveyor 14 and the blower 16 are immediately stopped by the safety device, now shown, and known per se. Since the fuel on the grate trough 11 no longer receives oxygen, its supply of heat energy is stopped almost abruptly so that overheating of the thermal oil within the pipe coils is prevented.

In the boiler units shown in FIGS. 2 and 3, the same parts as in FIG. 1 have been designated by the same reference numerals. While the boiler unit in FIG. 1 is effective in burning moist fuels, the unit in FIG. 2 is designed for the combustion of dry fuels and, therefore, does not require the refractory lining 10 on the circumferential surface of the combustion chamber. Accordingly, because of the resulting reduced height of the furnace, the secondary combustion air chamber 8*a* which supports the boiler portion of the unit is arranged concentrically about the primary combustion air chamber 12. The grate trough 11, as in FIG. 1, is centrally arranged within the primary combustion chamber 12 and is spaced below the upper end of the secondary chamber 8*a.* A screw conveyor 14 supplies the dry fuel to the grate trough. Directly above the grate trough, a sheet metal ring is spaced inwardly from and extends around the inner surface of the combustion chamber and secondary combustion air pipes 21*a* extend from the inner wall of the secondary chamber through the sheet metal ring for admitting secondary air into the combustion chamber. As with the ducts 21 in FIG. 1, the pipes 21*a* are arranged tangentially of the circumferential surface of the combustion chamber. In FIG. 1 the ducts 21 extend downwardly in the inward direction while in FIG. 2 the opposite is true with the pipes 21 extending slightly upwardly in the inward direction. The pipes 21*a* open into the combustion chamber above the grate trough 11 which has its bars extending obliquely downwardly to form a grate trough bottom.

The mode of operation and the construction of the arrangement shown in FIG. 2 is the same as that shown in FIG. 1 with the only differences being those described above.

Generally speaking, boilers formed in accordance with the present invention are suitable for fuels, such as wood or wood chips, wood dust is not suitable. The invention could also be used for certain types of coal particularly those types having a great portion of highly volatile components and a low portion of ashes.

The above description only set forth the essential features of the boiler unit and conventional devices could be provided for the removal of ashes, though they are not described.

As mentioned, the safety device for shutting down the operation of the screw conveyor 14 and the blower 16 when the pump ceases to operate is known per se and does not require any decription.

While specific embodiments of the invention have been shown and described in detail to illustrate the application of the inventive principles, it will be understood that the invention may be embodied otherwise without departing from such principles.

We claim:

1. Apparatus for using a solid fuel in heating a heat transfer fluid, such as a thermal oil, which is to be protected against overheating, comprising a boiler, means for effecting forced circulation of the heat transfer fluid through said boiler, said means for effecting forced circulation comprising an electrically operated pump, said boiler comprising a vertically arranged boiler casing forming a vertically extending passage, a pipe coil system located in said passage for flowing the heat transfer fluid therethrough, a furnace connected to said boiler for flowing heating gases into said passage for flow in indirect heat transfer relation with the heat transfer fluid within said pipe coil system, means for supplying solid fuel into said furnace, means for supplying combustion air into said furnace, an outlet connected to said casing for discharging heating gases after they flow over said pipe coil, and means for stopping the heating of said pipe coil system when the forced circulation of the heat transfer fluid stops, wherein the improvement comprises that said boiler casing is open at the bottom forming an opening into the lower end of said passage, said furnace comprises a vertically extending combustion chamber having an upper end and a lower end with said upper end thereof opening into the lower end of said passage for flowing heating gases from said combustion chamber into said passage, said furnace supporting the lower end of said boiler casing, and said means for stopping the heating of said pipe coil system being connected to said means for supplying solid fuel and to said means for supplying combustion air for rendering both of said means inoperative when the forced circulation of said heat transfer fluid is stopped.

2. Apparatus, as set forth in claim 1, wherein said furnace comprises first walls laterally enclosing said combustion chamber, and a horizontal second wall extending transversely of and across the lower end of said furnace and forming a base for said furnace, a central grate trough spaced above said second wall and located across the lower end of said combustion chamber, a primary combustion air chamber located between said grate and said second wall and enclosed laterally by said first walls, and said first walls defining an annular secondary combustion air chamber laterally enclosing said combustion chamber, and openings extending through said first walls above said grate trough for directing secondary air into said combustion chamber.

3. Apparatus, as set forth in claim 2, wherein said boiler casing and said pipe coil system are supported on the upper ends of said first walls defining said secondary combustion air chamber.

4. Apparatus, as set forth in claim 3, wherein said first walls include a vertically extending radially inner first wall defining the circumferential surface of said combustion chamber, and a heat-storing refractory material lining the inner surface of said inner first wall for directing radiant heat toward said grate for aiding in the combustion of relatively moist fuels.

5. Apparatus, as set forth in claim 4, wherein said inner first wall and said refractory material lining on said inner first wall taper inwardly at the upper end of said combustion chamber so that the inner surface of said refractory material directs radiant heat downwardly toward said grate.

6. Apparatus, as set forth in claim 4, wherein said secondary combustion air chamber laterally surrounds said inner first wall.

7. Apparatus, as set forth in claim 4, wherein said first walls include a horizontally extending first wall at the upper end of said furnace disposed between the lower ends of said pipe coil system and said refractory lining in said combustion chamber.

8. Apparatus, as set forth in claim 4, wherein a heat insulating section is located in said furnace between the lower end of said pipe coil system and said refractory material lining.

9. Apparatus, as set forth in claim 7, wherein the upper end of said inner first wall tapers inwardly relative to the lower end thereof and the inner end of said horizontal first wall extends inwardly into contact with the upper end of said inner first wall and forms two sides of an inwardly projecting triangularly shaped portion of said secondary combustion air chamber and said triangularly shaped portion providing a heat insulating section between said pipe coil system and said refractory lining on said inner first wall.

10. Apparatus, as set forth in claim 2, wherein said secondary combustion air chamber extends downwardly below said grate and laterally surrounds said primary combustion air chamber located below said grate.

11. Apparatus, as set forth in claim 2, wherein said secondary combustion air chamber is located above said grate and the lower end of said secondary combustion air chamber located above the upper end of said primary combustion air chamber.

12. Apparatus, as set forth in claim 4, wherein said openings from said secondary combustion air chamber extend through said inner first wall and said refractory material lining tangentially of the inwardly facing surface of said refractory material lining on the circumference of said combustion chamber.

13. Apparatus, as set forth in claim 10, wherein an upwardly extending auxiliary wall is supported on the upper end of said first walls and is located radially inwardly from the upper end of said first inner wall, and said openings from said secondary combustion air chamber comprising tubular members extending through said inner first wall and said auxiliary wall tangentially of the inner surface of said auxiliary wall.

14. Apparatus, as set forth in claim 2, wherein the baffle means are provided in said secondary combustion air chamber for directing air entering said secondary combustion air chamber to flow over the upper and radially inner surface thereof.

15. Apparatus, as set forth in claim 1, wherein said boiler casing includes a cover closing the upper end thereof, and means in said cover for introducing a gas into said boiler casing and furnace which prevents continued combustion within said combustion chamber when the forced circulation flow of the heat transfer fluid through said pipe coil system.

16. Apparatus, as set forth in claim 1, wherein said pipe coil system comprises a vertically extending inner pipe coil and a vertically extending outer pipe coil encircling and spaced radially outwardly from said inner pipe coil, said inner and outer pipe coils dividing said passage in said boiler casing into a first vertically extending pass locate inwardly of said inner pipe coil, a second vertically extending pass located between the outer surface of said inner pipe coil and the inner surface of said outer pipe coil, said first and second passes disposed in communication at the upper end of said inner pipe coil, and a third vertically extending pass located between the outer surface of said outer pipe coil and the inner surface of said boiler casing and said second and third passes disposed in communication at the lower end thereof.

17. Apparatus, as set forth in claim 16, wherein said inner and outer pipe coils each have a plurality of individual turns and the adjacent said individual turns of said inner pipe coil being disposed in surface contact so that the combustion gas can not flow between said individual turns and at least two individual turns of said outer pipe coil at the lower end thereof being in spaced relation for affording communication between the lower end of said second and third passes and the remainder adjacent said individual turns of said outer pipe coil being disposed in surface contact so that the individual gases can not flow between said individual turns.

18. Apparatus, as set forth in claim 16, wherein said inner pipe coil is aligned above the portion of said furnace defining the lateral surface of said combustion chamber.

19. Apparatus, as set forth in claim 16, wherein an inlet is arranged for supplying heat transfer fluid to the lower end of said pipe coil system and an outlet is arranged for withdrawing the heat transfer fluid from the upper end of said pipe coil system.

20. Apparatus, as set forth in claim 19, wherein said inner pipe coil and said outer pipe coil are arranged for flow of the heat transfer fluid therethrough in series.

21. Apparatus, as set forth in claim 19, wherein said inner pipe coil and said outer pipe coil are arranged for flow of the heat transfer fluid therethrough in parallel.

* * * * *